US007369788B2

(12) United States Patent
Omura et al.

(10) Patent No.: US 7,369,788 B2
(45) Date of Patent: May 6, 2008

(54) IMAGE FORMING APPARATUS HAVING HIGH VOLTAGE CIRCUIT BOARD AND DRIVING UNIT

(75) Inventors: Hiroyoshi Omura, Osaka (JP); Tomohide Hozono, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 349 days.

(21) Appl. No.: 11/281,900

(22) Filed: Nov. 18, 2005

(65) Prior Publication Data

US 2006/0153587 A1 Jul. 13, 2006

(30) Foreign Application Priority Data

Nov. 18, 2004 (JP) ..... 2004-334926

(51) Int. Cl.
*G03G 15/00* (2006.01)

(52) U.S. Cl. ..... 399/88; 399/89

(58) Field of Classification Search ..... 399/88, 399/89, 90, 116, 117, 167
See application file for complete search history.

(56) References Cited

U.S. PATENT DOCUMENTS 5,561,499 A * 10/1996 Setoriyama ..... 399/111
6,778,197 B2 * 8/2004 Yamanaka ..... 347/129
6,826,376 B2 * 11/2004 An et al. ..... 399/75
6,845,221 B2 * 1/2005 Mori et al. ..... 399/75
6,907,206 B2 * 6/2005 Hattori et al. ..... 399/90
2004/0126168 A1 * 7/2004 Fujimoto ..... 400/118.2

FOREIGN PATENT DOCUMENTS

JP 05008502 A * 1/1993
JP 08006472 A * 1/1996
JP 11133691 A * 5/1999
JP 2001-347723 12/2001
JP 2002268309 A * 9/2002
JP 2003-195697 7/2003

* cited by examiner

*Primary Examiner*—Robert Beatty
(74) *Attorney, Agent, or Firm*—Smith, Gambrell & Russell, LLP

(57) ABSTRACT

An image forming apparatus (1) according to the present invention includes a high voltage circuit board (14) and a driving unit (10). A frame (4B) is provided in the apparatus (1) to support an image forming unit (2). The frame (4B) has a partition face (5), which defines a boundary between an inner side (D1) and an outer side (D2) and faces toward the outer side (D2). An electric discharger (7) and driving mechanisms (11, 12, 13) are provided on the inner side (D1) inward of the partition face (5). The high voltage circuit board (14) and the driving unit (10) for operating the driving mechanisms (11, 12, 13) are provided on the outer side (D2) outward of the partition face (5). The high voltage circuit board (14) is fixed directly to the partition face (5) on the outer side (D2). The driving unit (10) is fixed to the partition face (5) from the outer side (D2) so as to be located outwardly of the high voltage circuit board (14) on the outer side (D2) and overlap the high voltage circuit board (14).

5 Claims, 6 Drawing Sheets

IMAGE FORMING APPARATUS HAVING HIGH VOLTAGE CIRCUIT BOARD AND DRIVING UNIT

BACKGROUND OF THE INVENTION

1. Field of the Invention

The present invention relates to an image forming apparatus, for example, a copying machine, a printer, a facsimile machine or the like.

2. Description of Related Art

Image forming apparatuses typically include a hollow cylindrical rotatable photosensitive drum on which an electrostatic latent image is formed according to a light distribution, an electric discharger which electrically charges the photosensitive drum by applying a high voltage, a developing device which develops the electrostatic latent image formed on the photosensitive drum with toner supplied by a developer roller, and the like. The photosensitive drum and the developer roller are driven by a driving unit including an electric motor. Further, a high voltage circuit board is provided for applying the high voltage to the electric discharger (see, for example, Japanese Unexamined Patent Publication No. 2001-347723 and Japanese Unexamined Patent Publication No. 2003-195697).

In such an image forming apparatus, the high voltage circuit board is typically fixed to a planar frame via a columnar fixing member. The high voltage circuit board may be juxtaposed with the driving unit on a common side face of the frame (see, for example, Japanese Unexamined Patent Publication No. 2001-347723), or disposed in a front portion or an upper portion of the image forming apparatus apart from the driving unit disposed in a rear portion of the image forming apparatus.

Since the fixing member for the high voltage circuit board is provided separately from the frame, a greater number of components and higher production costs are required.

Where the high voltage circuit board is disposed a part from the driving unit, a housing space for the driving unit and a housing space for the high voltage circuit board should be separately provided. As a result, the size of the entire apparatus is increased. Where the high voltage circuit board and the driving unit are disposed in juxtaposition on the common side face of the frame, the problem associated with the housing spaces is encountered as in the aforesaid case, resulting in increase in the size of the entire apparatus.

SUMMARY OF THE INVENTION

It is therefore a principal object of the present invention to provide a smaller size image forming apparatus.

It is another object of the present invention to provide an improved assembly of a high voltage circuit board and a driving unit in an image forming apparatus.

An image forming apparatus according to the present invention comprises a frame having a partition face which defines a boundary between an inner side and an outer side, an electric discharger disposed inwardly of the partition face, a driving mechanism disposed inwardly of the partition face and operative for image formation, a high voltage circuit board disposed outwardly of the partition face for applying a high voltage to the electric discharger, and a driving unit disposed outwardly of the partition face for operating the driving mechanism. The high voltage circuit board is fixed directly to the partition face on the outer side. The driving unit is fixed to the partition face on the outer side so as to be located outwardly of the high voltage circuit board and at least partly overlap the high voltage circuit board.

According to the present invention, the high voltage circuit board and the driving unit are disposed in proximity to each other by locating the driving unit outwardly of the high voltage circuit board in overlapping relation, so that a housing space for the high voltage circuit board and the driving unit is reduced as compared with a case in which a housing space for the high voltage circuit board and a housing space for the driving unit are separately provided.

Further, the high voltage circuit board is disposed in proximity to the frame and directly fixed to the frame. This simplifies an arrangement for fixing the high voltage circuit board to the frame, and reduces the number of the components.

DETAILED DESCRIPTION OF PREFERRED EMBODIMENTS

An embodiment of the present invention will hereinafter be described in detail with reference to the attached drawings.

In this embodiment, a tandem full color printer will be described as an example of the inventive image forming apparatus, but the present invention is not limited to the tandem full color printer. Other examples of the image forming apparatus include copying machines, facsimile machines and image forming apparatuses adapted to form a monochrome image.

Figure 1:
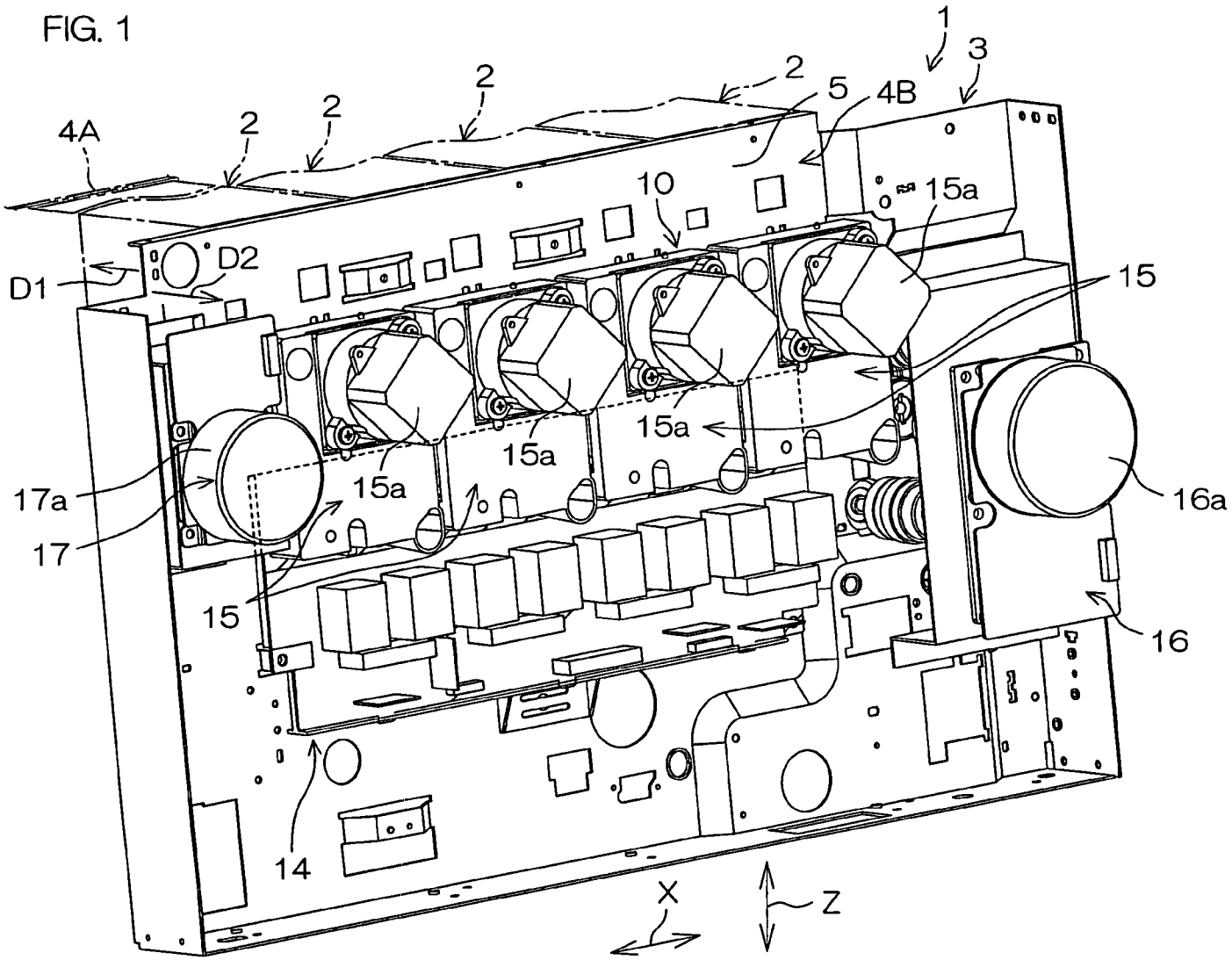
FIG. 1 is a perspective view of major portions of an image forming apparatus according to one embodiment of the present invention as seen from a rear side.

FIG. 1 is a perspective view of major portions of the image forming apparatus according to the embodiment of the present invention as seen from a rear side.

The image forming apparatus 1 includes a plurality of image forming units 2 (e.g., four image forming units 2) for yellow, magenta, cyan and black images, and a structural member 3 which supports these image forming units 2. In this embodiment, the four image forming units 2 are arranged laterally along an X-axis. The direction of the arrangement of the image forming units 2 may be arbitrarily defined.

The structural member 3 includes a pair of planar frames 4A, 4B which are respectively disposed on a front side and a rear side of the image forming units 2. The frames 4A, 4B are spaced a predetermined distance from each other, and connected to each other by a connection member (not shown). The frame 4B and its peripheral portion will be mainly described below.

Figure 2:
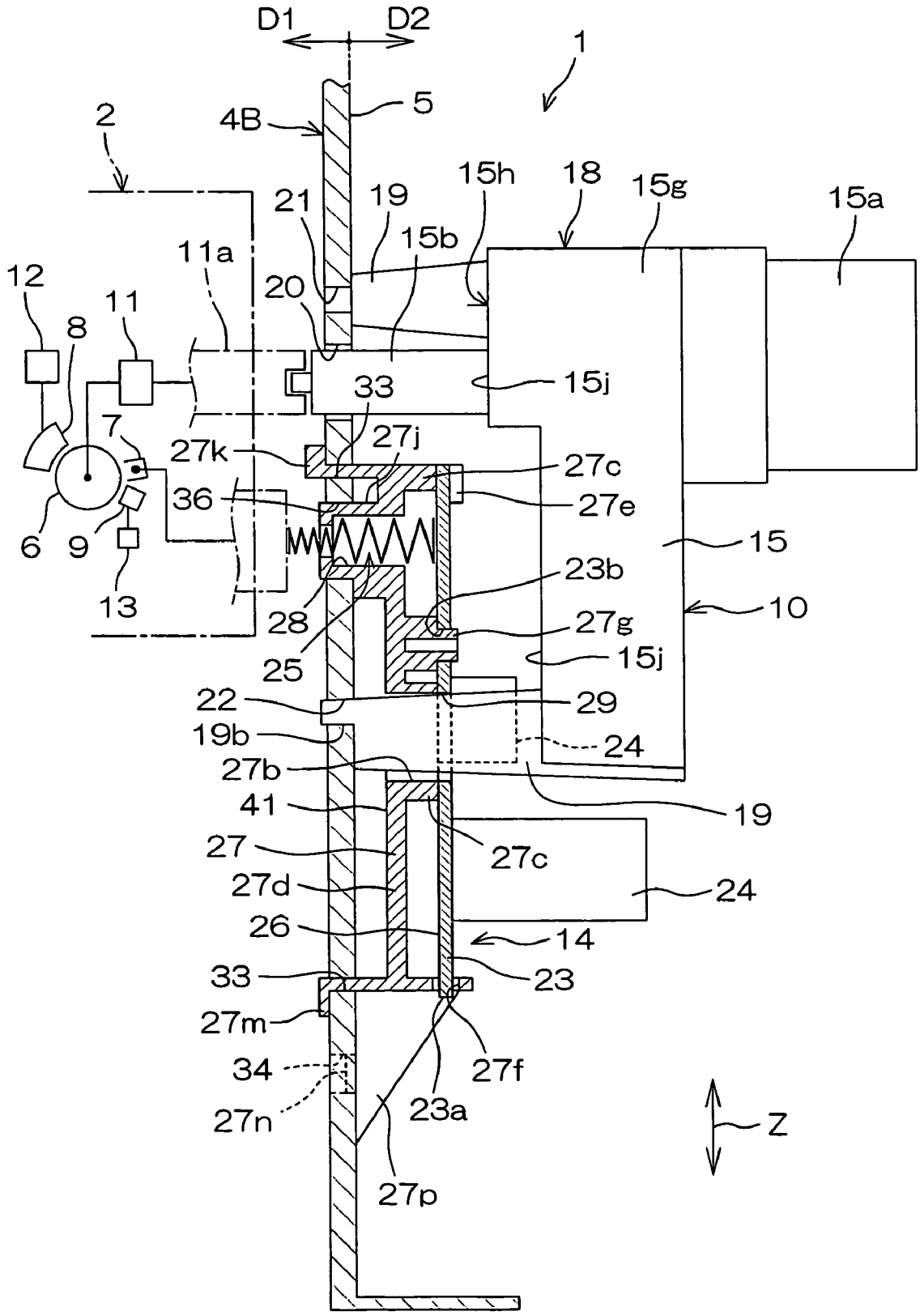
FIG. 2 is a sectional view of a frame and other major portions of the image forming apparatus of FIG. 1 taken along a line II-II in FIG. 4.

FIG. 2 is a sectional view of the frame 4B and its peripheral portion as major portions of the image forming apparatus 1 shown in FIG. 1. A reference will be made to FIGS. 1 and 2.

The frame 4B is an electrically conductive metal plate, which extends vertically along a Z-axis and along the X-axis along which the image forming units 2 are arranged. The frame 4B has a partition face 5 on a side opposite from the image forming units 2. The partition face 5 defines a boundary between an inner side D1 on which the image forming units 2 are provided and an outer side D2 opposite from the inner side D1. More specifically, the partition face 5 of the frame 4B is defined by a rear surface of the frame 4B facing toward the outer side D2. The inner side D1 corresponds to the front side, and the outer side D2 corresponds to the rear side.

The four image forming units 2 have the same construction. The image forming units 2 each include a hollow cylindrical photosensitive drum 6 on which an electrostatic latent image is formed according to a light distribution, an electric discharger 7 which electrically charges the photosensitive drum 6, a developing device 8 which develops the electrostatic latent image formed on the photosensitive drum 6 into a toner image with toner supplied from a toner container by a developer roller, and a cleaner 9 for cleaning a surface of the photosensitive drum 6 after the toner image is transferred. These elements 6, 7, 8, 9 are disposed on the inner side D1 inward of the partition face 5.

In each of the image forming units 2, an outer peripheral surface of the photosensitive drum 6 is uniformly electrically charged by the electric discharger 7, while the photosensitive drum 6 is rotated. Then, the outer peripheral surface of the photosensitive drum 6 is exposed to a laser beam emitted from a laser beam generator (not shown). Thus, an electrostatic latent image corresponding to a desired image is formed on the outer peripheral surface of the photosensitive drum 6, and developed into a toner image of a predetermined color by the developing device 8. The toner images of the respective colors formed on the photosensitive drums 6 are successively transferred onto a paper sheet in superposed relation by a transfer device (not shown), and thermally fixed to the paper sheet in a fixing device.

The image forming apparatus 1 further includes a driving unit 10, driving mechanisms 11 which are each driven by the driving unit 10 to rotate the photosensitive drum 6, driving mechanisms 12 which are each driven by the driving unit 10 to drive a developer roller of the developing device 8, driving mechanisms 13 which are each driven by the driving unit 10 to drive a cleaning roller of the cleaner 9, and a high voltage circuit board 14 which applies a high voltage to the electric discharger 7.

The driving mechanisms 11 are provided for the respective image forming units 2, and each include a transmission shaft 11*a* as a power transmission member, and a joint is provided at an end of the transmission shaft 11*a*. Though not shown but in a similar manner, the driving mechanisms 12, 13 are provided for the respective image forming units 2, and each include a transmission shaft as a power transmission member, and a joint is provided at an end of the transmission shaft.

The driving mechanisms 11, 12, 13, the driving unit 10 and the high voltage circuit board 14 are disposed in the vicinity of the frame 4B. The driving mechanisms 11, 12, 13 are disposed on the inner side D1 inward of the partition face 5 of the frame 4B. The driving unit 10 and the high voltage circuit board 14 are disposed on the outer side D2 outward of the partition face 5 of the frame 4B.

Particularly, in this embodiment, the high voltage circuit board 14 is fixed directly to the partition face 5 of the frame 4B from the outer side D2.

The driving unit 10 is fixed to the partition face 5 of the rear frame 4B from the outer side D2 so that the driving unit 10 at least partly overlaps at least a part of the high voltage circuit board 14 as seen anteroposteriorly in a D1-D2 direction and is located outwardly of an overlapped portion of the high voltage circuit board 14 on the outer side D2.

The driving unit 10 and the high voltage circuit board 14 may completely overlap each other. One of the driving unit 10 and the high voltage circuit board 14 may completely overlap a part of the other. Further, the driving unit 10 and the high voltage circuit board 14 may partly overlap each other.

In this embodiment, the driving unit 10 is fixed to the partition face 5 of the frame 4B from the outer side D2 so that a lower half of the driving unit 10 overlaps an upper half of the high voltage circuit board 14 as seen anteroposteriorly, and the driving unit 10 is located outwardly of the overlapped portion of the high voltage circuit board 14 on the outer side D2.

In this embodiment, the driving unit 10 includes four individual units 15 provided for the respective four image forming units 2, and two common units 16, 17 which are shared by the four image forming units 2. These four individual units 15 and the two common units 16, 17 are individually detachable from the frame 4B.

The common unit 16 includes an electric motor 16*a* for driving the four developing devices 8. The common unit 17 includes an electric motor 17*a* for driving the four cleaners 9.

Figure 3:
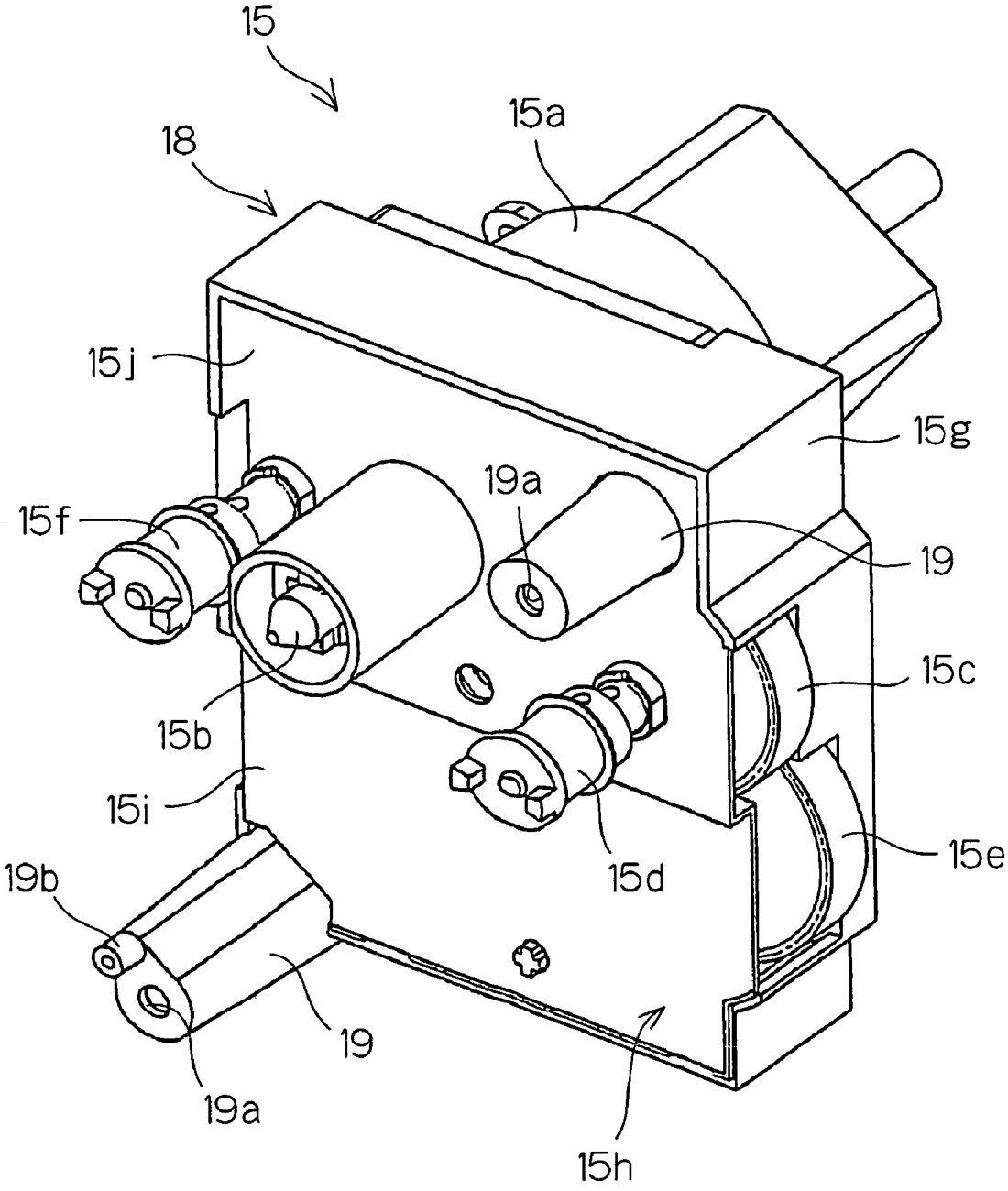
FIG. 3 is a perspective view of an individual unit of FIG. 2 as seen from a front side.

FIG. 3 is a perspective view of one of the individual units 15 as seen from a front side. A reference will be made to FIGS. 1 and 3.

The individual units 15 each include an electric motor 15*a* for driving the photosensitive drum 6 of the corresponding image forming unit 2, and transmission shafts 15*b*, 15*d*, 15*f* provided as power transmission members respectively connected to the photosensitive drum 6, the developing device 8 and the cleaner 9 of the corresponding image forming unit 2. Joints are provided at ends of the respective transmission shafts 15*b*, 15*d*, 15*f*.

An output shaft of the electric motor 15*a* of the individual unit 15 is connected to the transmission shaft 15*b* of the individual unit 15. An output shaft of the electric motor 16*a* is connected to the transmission shafts 15*d* of the four individual units 15 via a series of gears 15*c* provided in the respective individual units 15. An output shaft of the electric motor 17*a* is connected to the transmission shafts 15*f* of the four individual units 15 via a series of gears 15*e* provided in the respective individual units 15.

Referring to FIGS. 1, 2 and 3, the individual units 15 are disposed on a side opposite from the corresponding image forming units 2 with respect to the frame 4B. The frame 4B has a plurality of through-holes 20 provided in association with the transmission shafts 15*b*, 15*d*, 15*f* of the individual units 15 (in FIG. 2, only one through-hole 2 of or the transmission shaft 15*b* is shown) The transmission shafts 15*b*, 15*d*, 15*f* of the individual units 15 respectively extend through the through-holes 20. The transmission shafts 15*b*, 15*d*, 15*f* of the respective individual units 15 are connected to the corresponding driving mechanisms 11, 12, 13 of the image forming units 2 via the joints provided at the ends thereof.

Referring to FIGS. 2 and 3, the individual units 15 each include a unit body 18 and a plurality of fixing legs 19 (e.g., two fixing legs 19) projecting from the unit body 18 to a predetermined length. The legs 19 project forward from the unit body 18 to the partition face 5, and fixed to the frame 4B. The unit body 18 is spaced a predetermined distance outward from the partition face 5 on the outer side D2 by the two legs 19.

The unit body 18 includes the electric motor 15*a*, the transmission shafts 15*b*, 15*d*, 15*f*, the series of gears 15*c*, 15*e*, and a box-shaped housing 15*g* by which the electric motor 15*a*, the transmission shafts 15*b*, 15*d*, 15*f* and the series of gears 15*c*, 15*e* are supported. The legs 19 and the housing 15*g* are integrally formed of an insulative synthetic resin material.

The housing 15*g* has a face 15*h* opposed to the partition face 5. The opposed face 15*h* has a lower area 15*i* overlapping the upper half of the high voltage circuit board 14 and spaced a greater distance from the partition face 5, and an upper area 15*j* not overlapping the high voltage circuit board 14 and spaced a smaller distance from the partition face 5.

The transmission shafts 15*b*, 15*d*, 15*f* and one of the legs 19 are disposed on the upper area 15*j* as projecting from the upper area 15*j*. The other leg 19 is disposed on the lower area 15*i*.

The legs 19 each have a through-hole 19*a*. The frame 4B has threaded through-holes 21 provided in opposed relation to the through-holes 19*a*. Bolts (not shown) are screwed into the through-holes 21 of the frame 4B through the through-holes 19*a*, whereby the legs 19 are fixed to the frame 4B. Further, the other leg 19 has a projection 19*b* as a positioning engagement portion. The projection 19*b* is engaged with an engagement hole 22 provided as a positioning engagement portion in the frame 4B, whereby the housing 15*g* is positioned in a predetermined position on the frame 4B.

Figure 4:
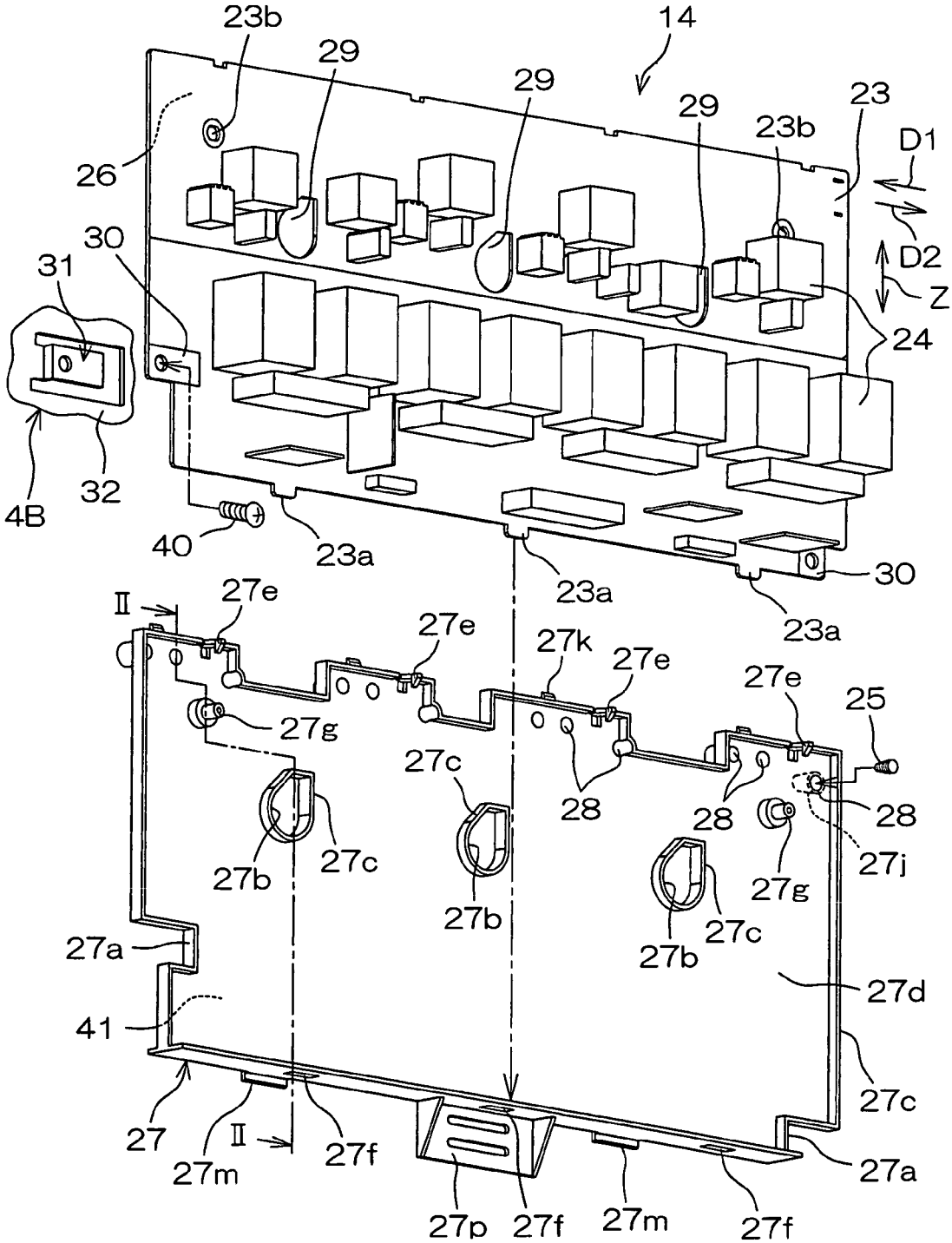
FIG. 4 is an exploded perspective view of a high voltage circuit board and the like shown in FIG. 2.

FIG. 4 is an exploded perspective view of the high voltage circuit board and the like. A reference will be made to FIGS. 2 and 4.

The high voltage circuit board 14 includes a printed wiring board 23, components 24 mounted on a surface of the wiring board 23, resilient connectors 25, and an insulative planar cover 27. The printed wiring board 23 and the mounted components 24 constitute a circuit board assembly as a circuit board body. The circuit board assembly is shared by the four image forming units 2. The cover 27 is attached to an inner face 26 of the circuit board assembly (a back surface of the printed wiring board 23) as covering the inner face 26. The cover 27 includes retaining portions 28 which respectively retain the resilient connectors 25. The circuit board assembly and the cover 27 constitute a board unit, which is detachable from the frame 4B.

The mounted components 24 include circuit elements, such as a transformer, which constitute a high voltage circuit.

The printed wiring board 23 includes an insulative board having a rectangular shape elongated in one direction, and a predetermined electrically conductive pattern formed on the insulative board. The aforesaid circuit elements and the electrically conductive pattern are electrically connected to constitute the high voltage circuit for applying a high voltage to the electric discharger 7.

In this embodiment, no component 24 is mounted on the back surface of the printed wiring board 23, but components having a smaller size or a smaller thickness may be mounted on the back surface of the printed wiring board 23.

Components 24 each having a smaller height are mounted on an upper area of a surface of the printed wiring board 23 overlapping the driving unit 10, and components 24 each having a greater height are mounted on a lower area of the surface of the printed wiring board 23 not overlapping the driving unit 10. The printed wiring board 23 has three through-holes 29 provided in the upper area thereof for receiving the other legs 19 of three of the four individual units 15 of the driving unit 10.

The printed wiring board 23 has a plurality of fixing portions 30 (two fixing portions 30 in this embodiment) for fixing the printed wiring board 23 directly to the frame 4B. The two fixing portions 30 are provided in longitudinally opposite edge portions of the printed wiring board 23. The fixing portions 30 each have a through-hole, around which parts of the electrically conductive pattern are provided on opposite sides of the fixing portion 30.

The frame 4B has a plurality of to-be-fixed portions 31 provided in opposed relation to the fixing portions 30 of the printed wiring board 23. The to-be-fixed portions 31 are formed integrally with the frame 4B. More specifically, the to-be-fixed portions 31 are cantilever tongues which are each formed by incising and raising a part of a flat portion 32 of the frame 4B. The tongues each have a seat spaced a predetermined distance outward from the flat portion 32 of the frame 4B on the outer side D2, and the seat is formed with an through-hole. The through-hole of the seat is formed with a female thread.

Bolts 40 are respectively screwed into the through-holes of the to-be-fixed portions 31 through the through-holes of the fixing portions 30. Thus, the fixing portions 30 of the printed wiring board 23 are fixed between heads of the bolts 40 and the seats of the to-be-fixed portions 31. The parts of the electrically conductive pattern around the fixing portions 30 of the printed wiring board 23 are electrically connected to the frame 4B for grounding by the bolts 40 and by keeping the seats of the to-be-fixed portions 31 in face-to-face contact with inner surfaces of the fixing portions 30.

The cover 27 is an insulative synthetic resin member separate from the printed wiring board 23. The cover 27 has clearance portions 27*a* so as not to cover the fixing portions 30 and the to-be-fixed portions 31. The cover 27 is fixed to the inner face 26 of the circuit board assembly of the high voltage circuit board 14 to cover a lower end face of the printed wiring board 23 and the entire inner face 26 except for the clearance portions 27*a*. Particularly, the cover 27 covers a portion of the high voltage circuit board 14 to which the high voltage is applied.

The cover 27 has three through-holes 27*b* provided in opposed relation to the through-holes 29 of the printed wiring board 23 for receiving the legs 19. The cover 27 has projections 27*c* extending along outer peripheral edges thereof and peripheral edges of the through-holes 27*b* and projecting outward from a flat portion 27*d* on the outer side D2. The projections 27*c*, except that provided along a lower edge of the cover 27, abut against outer peripheral edge portions of the back surface of the printed wiring board 23 and peripheral edges of the through-holes 29. The projection 27*c* provided along the lower edge of the cover 27 projects to a greater extent to cover the lower end face of the printed wiring board 23. The flat portion 27*d* of the cover 27 is spaced a predetermined distance from the inner face 26 of the circuit board assembly of the high voltage circuit board 14.

The cover 27 is capable of retaining the printed wiring board 23. That is, four hooks 27*e* are provided on an upper edge of the cover 27 in a vertically resiliently deformable manner as projecting outward on the outer side D2. An upper edge portion of the printed wiring board 23 is hooked by the hooks 27*e* to be held between the hooks 27*e* and the projections 27*c* provided along an upper edge of the cover 27. The projection 27*c* provided along the lower edge of the cover 27 has three engagement holes 27*f*. Projections 23*a* projecting downward from a lower edge of the printed wiring board 23 are fitted in the engagement holes 27*f*. Three cylindrical positioning projections 27*g* projecting outward from the flat portion 27*d* of the cover 27 on the outer side D2 are respectively engaged with engagement holes 23*b* of the printed wiring board 23.

Figure 5:
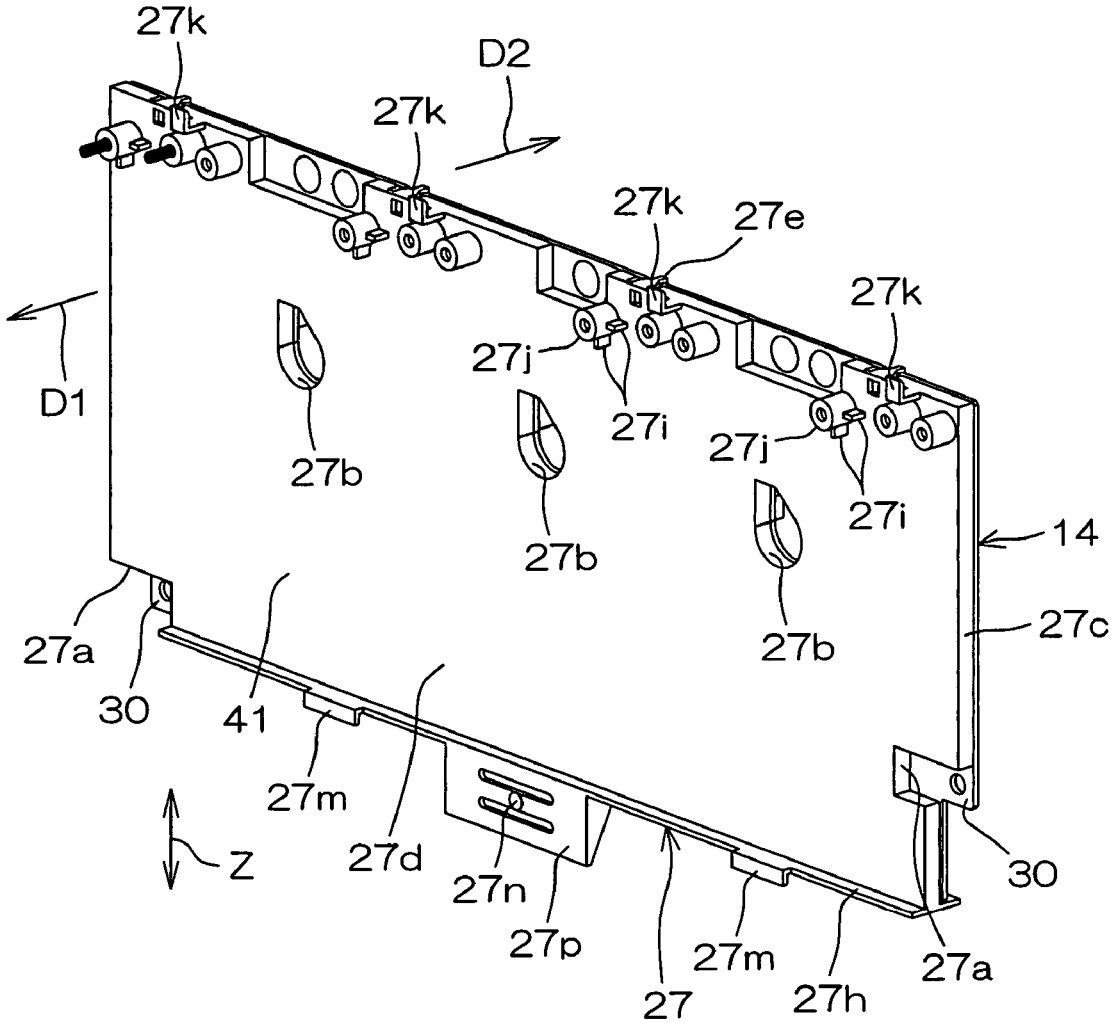
FIG. 5 is a perspective view of the high voltage circuit board of FIG. 4 as seen from a front side.

FIG. 5 is a perspective view of the board unit as seen from the front side. A reference will be made to FIGS. 2 and 5.

The cover 27 is held on the partition face 5 of the frame 4B. With the provision of the cover 27, the high voltage circuit board 14 can be easily fixed directly to the frame 4B.

That is, the cover 27 has a first projection 27*h* and second projections 27*i* which abut against the frame 4B so that the flat portion 27*d* is spaced a predetermined distance from the partition face 5 of the frame 4B. The first projection 27*h* is a flange extending along the lower edge of the cover 27 and projecting to a predetermined distance from the flat portion 27*d* toward the inner side D1. The second projections 27*i* are ribs provided on the upper edge portion of the cover 27 as projecting to a predetermined distance from the flat portion 27*d* toward the inner side D1. These ribs are provided at proximal portions of the bosses 27*j*.

The cover 27 further has four hooks 27*k* projecting from the upper edge thereof toward the inner side D1 with their distal portions bent upward, and two hooks 27*m* projecting from the first projection 27*h* thereof toward the inner side D1 with their distal portions bent downward. The frame 4B has engagement holes 33 provided in opposed relation to the hooks 27*k*, 27*m*. The hooks 27*k*, 27*m* respectively extend through the engagement holes 33 with the distal portions thereof abutting against peripheral edge portions of the engagement holes 33 from the inner side D1, whereby the cover 27 is prevented from being disengaged from the frame 4B to the outer side D2.

The cover 27 further has a cylindrical positioning projection 27*n* projecting from a flange 27*p* provided on the lower edge thereof toward the inner side D1. The projection 27*n* is fitted in an engagement hole 34 of the frame 4B, thereby restricting vertical and lateral movement of the cover 27 relative to the frame 4B.

The four retaining portions 28 are provided on the cover 27 for the respective image forming units 2. The retaining portions 28 are disposed in the vicinity of the corresponding image forming units 2 on the upper edge portion of the cover 27 which overlaps the driving unit 10.

Figure 6:
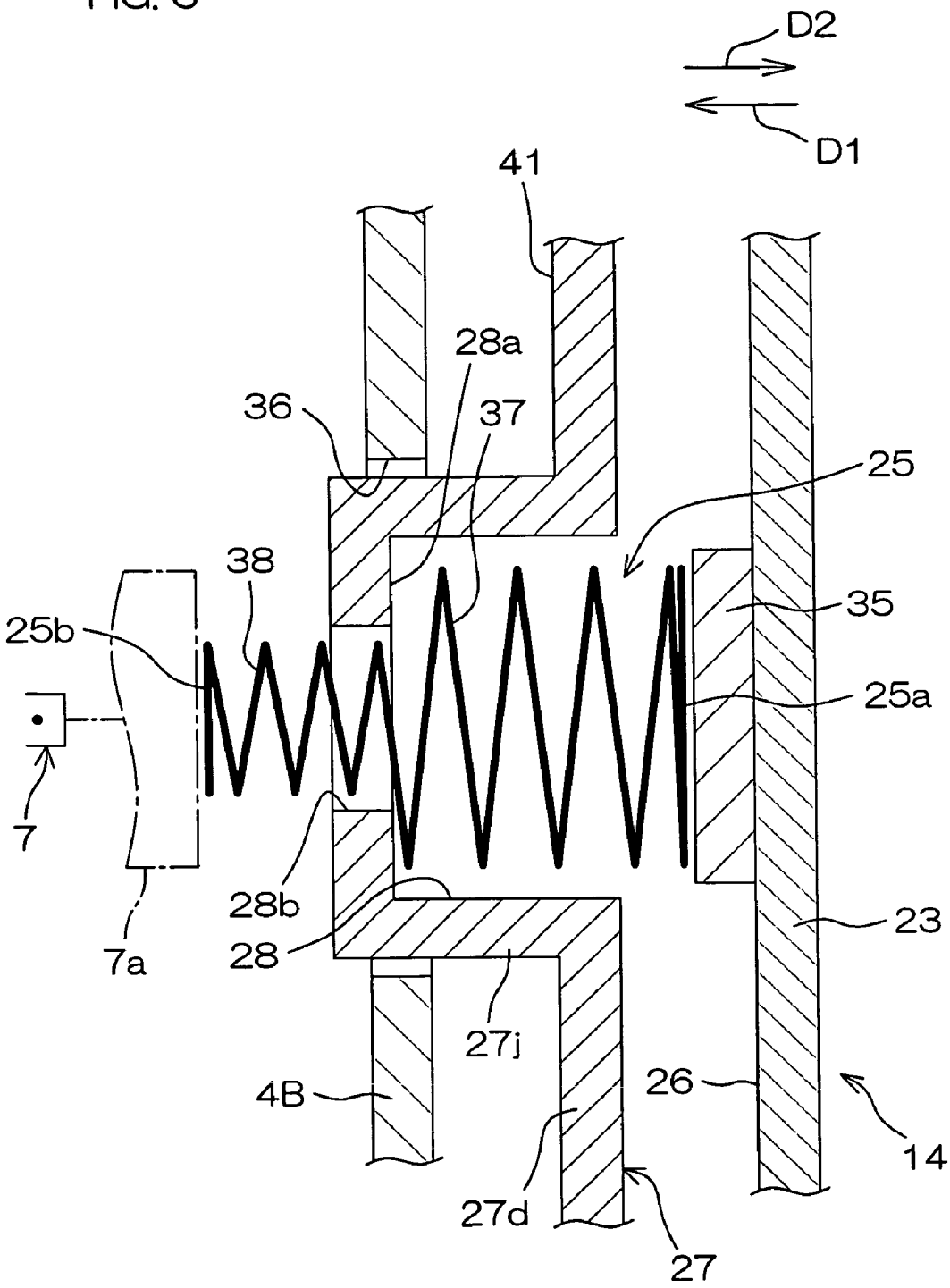
FIG. 6 is a schematic sectional view of a retaining portion shown in FIG. 2.

FIG. 6 is a schematic sectional view of one of the retaining portions.

A terminal 35 is provided on the inner face 26 of the circuit board assembly of the high voltage circuit board 14 in opposed relation to the retaining portion 28. The frame 4B has a through-hole 36. A terminal 7*a* of the electric discharger 7 is disposed on the inner side D1 inward of the frame 4B. The retaining portion 28, the terminal 35, the through-hole 36, the terminal 7*a* and the resilient connector 25 retained in the retaining portion 28 are arranged along an anteroposteriorly extending axis.

Examples of the electric discharger include the developing device 8 and the transfer device in addition to the electric discharger 7, and at least one of these devices may be connected to the high voltage circuit board 14 as in this embodiment. In this case, the retaining portion 28, the resilient connector 25, the terminal 35 and the like may be configured in substantially the same manner as described above, except that the electric discharger to be connected to the resilient connector 25 is different. An explanation will be given to a case where the electric discharger is the electric discharger 7 of the image forming unit 2.

The resilient connector 25 includes a compression coil spring composed of an electrically conductive material. Terminals 25*a*, 25*b* are provided at opposite ends of the spring. In this embodiment, the resilient connector 25 has a greater diameter portion 37 having a greater outer diameter and a smaller diameter portion 38 having a smaller outer diameter. The greater diameter portion 37 and the smaller diameter portion 38 are coaxial and continuous, and composed of a single wire material.

The retaining portion 28 is formed integrally with the cover 27. The retaining portion 28 has a bottomed hollow cylindrical shape, and is defined in the boss 27*j* projecting from the flat portion 27*d* of the cover 27 toward inner side D1. The resilient connector 25 is retained along an inner peripheral surface of the boss 27*j*. A through-hole 28*b* is provided in a bottom 28*a* of the retaining portion 28.

A step between the smaller diameter portion 38 and the greater diameter portion 37 abuts against the bottom 28*a* of the retaining portion 28. The smaller diameter portion 38 extends through the through-hole 28*b*. The greater diameter portion 37 of the resilient connector 25 is held between the bottom 28*a* of the retaining portion 28 and the printed wiring board 23, whereby the resilient connector 25 is prevented from being disengaged from the retaining portion 28.

The terminal 35 is provided as a part of the electrically conductive pattern of the printed wiring board 23, but may be provided as a separate electrically conductive member attached to the printed wiring board 23.

The boss 27*j*, which serves as an insulative member of the retaining portion 28, extends through the through-hole 36 of the frame 4B, whereby the resilient connector 25 is assuredly electrically isolated from the frame 4B. The resilient connector 25 is compressed to be resiliently deformed in the retaining portion 28 with its terminal 25*a* in contact with the terminal 35 of the high voltage circuit board 14 for electrical connection. Further, the terminal 25*b* projects inwardly of the partition face 5 to the inner side D1 to contact the terminal 7*a* of the electric discharger for electrical connection. As a result, electrical connection between the high voltage circuit board 14 and the electric discharger is established.

According to the embodiment of the present invention, the driving unit 10 is provided outwardly of the high voltage circuit board 14 on the outer side D2 as overlapping the high voltage circuit board 14. Thus, the high voltage circuit board 14 and the driving unit 10 can be disposed in proximity to each other, so that a housing space for the driving unit 10 and the high voltage circuit board 14 can be reduced as compared with a case where a housing space for the driving unit 10 and a housing space for the high voltage circuit board 14 are separately provided. Further, the frame 4B and the high voltage circuit board 14 are disposed in face-to-face opposed relation, so that the driving unit 10 and the high voltage circuit board 14 can be disposed with an improved space saving efficiency. Since the driving unit 10 and the high voltage circuit board 14 are disposed in close proximity to components to be connected thereto, arrangements for the electrical and mechanical connection can be simplified. For example, the electrical connection between the high voltage circuit board 14 and the electric discharger can be established without wiring, so that the assembling efficiency can be improved.

The high voltage circuit board 14 is fixed directly to the frame 4B in close proximity. This simplifies the arrangement for fixing the high voltage circuit board 14 to the frame 4B and reduces the number of the components.

Since the driving unit 10 has the legs 19, the unit bodies 18 of the driving unit 10 can be fixed to the frame 4B in spaced relation by the legs 19. Therefore, the high voltage circuit board 14 can be disposed between the unit bodies 18 and the frame 4B in overlapping relation.

The resilient connector 25, which is resiliently deformable, accommodates its dimensional error and assembling error, so that the electrical connection can be assuredly established. Therefore, a wiring is not required for connection between the high voltage circuit board 14 and the electric discharger, so that the assembling costs can be reduced.

Since the insulative cover 27 assuredly electrically isolates the high voltage circuit board 14 from the frame 4B, the distance between the frame 4B and the high voltage circuit board 14 is reduced as compared with a case where the printed wiring board 23 is not covered with the insulative cover 27. This reduces the size of the image forming apparatus 1.

The following modifications of the embodiment are conceivable. Arrangements different from those of the embodiment described above will hereinafter be mainly described, and like components will be denoted by like reference characters.

For example, the number of the legs 19 may be at least one, and the legs 19 may be provided separately from the housing 15*g* and fixed to the housing 15*g*. Further, it is also conceivable to support the unit bodies 18 by support portions projecting from the frame 4B to the outer side D2 without the provision of the legs 19. The functions of the four individual units 15 and the two common units 16, 17 may be integrated in the driving unit 10.

The cover 27 may cover only the inner face 26 of the circuit board assembly. At least an inner surface 41 of the high voltage circuit board 14 opposed to the frame 4B may be composed of an insulative material or covered with an insulative member. The insulative member maybe an insulative synthetic resin member, which is formed integrally with the printed wiring board 23 to substantially entirely cover the inner surface of the printed wiring board 23. It is also conceivable to eliminate the cover 27. In this case, the distance between the high voltage circuit board 14 and the frame 4B is preferably increased as compared with the case where the cover 27 is provided.

It is also conceivable to fix the resilient connector 25 to the high voltage circuit board 14 or to hold the resilient connector 25 on the electric discharger. The resilient connector 25 maybe a compression coil spring having a constant outer diameter or a leaf spring.

In the arrangement for fixing the high voltage circuit board 14 directly to the frame 4B, the high voltage circuit board 14 may be only mechanically connected to the frame 4B. It is also conceivable to fix the high voltage circuit board 14 to the frame 4B via the cover 27 without the use of the bolts 40 for the fixing. The fixing portions 30 may be provided as at least parts of components mounted on the printed wiring board. The to-be-fixed portions 31 of the frame 4B may be components integrally fixed to the frame 4B.

The frame 4B may be composed of a material such as a synthetic resin material other than a metal. Further, it is also conceivable to fix the driving unit 10, the high voltage circuit board 14 and the like to the frame 4A in substantially the same manner as described above.

Other various modifications maybe made within the scope of the present invention defined by the appended claims.

What is claimed is:

1. An image forming apparatus comprising:

a frame having a partition face which defines a boundary between an inner side and an outer side;

electric discharger provided inwardly of the partition face;

a driving mechanism provided inwardly of the partition face and operative for image formation;

a high voltage circuit board provided outwardly of the partition face for applying a high voltage to the electric discharger; and a driving unit provided outwardly of the partition face for operating the driving mechanism, wherein the high voltage circuit board is fixed directly to the partition face on the outer side, and the driving unit is fixed to the partition face on the outer side so as to be located outwardly of the high voltage circuit board and at least partly overlap the high voltage circuit board.

2. An image forming apparatus as set forth in claim 1, wherein the driving unit includes a unit body, and a fixing leg projecting from the unit body to the partition face, and the unit body is spaced a predetermined distance outward from the partition face by the leg.

3. An image forming apparatus as set forth in claim 1, wherein the high voltage circuit board includes a resilient connector projecting inwardly of the partition face, and the resilient connector is electrically connected to the electric discharger provided inwardly of the partition face through a hole formed in the partition face.

4. An image forming apparatus as set forth in claim 2, wherein the high voltage circuit board includes a resilient connector projecting inwardly of the partition face, and the resilient connector is electrically connected to the electric discharger provided inwardly of the partition face through a hole formed in the partition face.

5. An image forming apparatus as set forth in claim 4, wherein the high voltage circuit board has an inner surface covered with an insulative member.

* * * * *